US007234634B1

(12) United States Patent
Payne et al.

(10) Patent No.: US 7,234,634 B1
(45) Date of Patent: Jun. 26, 2007

(54) MAIL BOX GUARD LOCKING INSERT

(76) Inventors: Calvin Payne, 1318 37th St., Everett, WA (US) 98201; Linda Payne, 1318 37th St., Everett, WA (US) 98201

( * ) Notice: Subject to any disclaimer, the term of this patent is extended or adjusted under 35 U.S.C. 154(b) by 0 days.

(21) Appl. No.: 11/594,616

(22) Filed: Nov. 7, 2006

(51) Int. Cl.
*B65G 11/04* (2006.01)

(52) U.S. Cl. ..... 232/45; 232/29; 232/17

(58) Field of Classification Search ..... 232/45, 232/29, 17, 44; D99/29–32
See application file for complete search history.

(56) References Cited

U.S. PATENT DOCUMENTS

| | | | | | |
|---|---|---|---|---|---|
| 755,038 | A * | 3/1904 | Palmer | ..... | 232/24 |
| 4,333,603 | A * | 6/1982 | Carlson | ..... | 232/17 |
| 4,361,271 | A * | 11/1982 | Hester et al. | ..... | 232/17 |
| 4,696,652 | A * | 9/1987 | Reeder et al. | ..... | 446/75 |
| 4,726,512 | A * | 2/1988 | White | ..... | 232/17 |
| 4,993,626 | A | 2/1991 | Berry | | |
| 5,009,366 | A | 4/1991 | Van Druff, Jr. et al. | | |
| 5,390,849 | A * | 2/1995 | Frissard | ..... | 232/45 |
| 5,526,979 | A | 6/1996 | Mann | | |
| 5,915,618 | A | 6/1999 | Gaudet | | |
| 6,808,108 | B1 * | 10/2004 | Turnbow et al. | ..... | 232/29 |
| 6,974,074 | B1 | 12/2005 | Watts | | |
| 7,070,090 | B2 * | 7/2006 | Ranen | ..... | 232/45 |
| 2005/0258226 | A1 * | 11/2005 | Kujawa et al. | ..... | 232/17 |

* cited by examiner

*Primary Examiner*—William L. Miller

(57) ABSTRACT

A unit is located inside a mailbox which prevents access to the mailbox through the door of the mailbox when the unit is in place. The unit includes a fence-like portion that is attached to the mailbox body by an arm that is locked to the mailbox in the rear of the mailbox. The fence-like portion is locked to the arm and is attached to the mailbox by a hinge. When unlocked, the fence can be pivoted out of the way to allow access to inside of the mailbox.

2 Claims, 1 Drawing Sheet

MAIL BOX GUARD LOCKING INSERT

TECHNICAL FIELD OF THE INVENTION

The present invention relates to the general art of mailboxes, and to the particular field of security mailboxes.

BACKGROUND OF THE INVENTION

Many citizens in this country have mail delivered to mailboxes remote from their home, usually located adjacent a nearby main thoroughfare. Mailboxes used are commonly mounted on poles or other suitable supports, and are generally formed of elongated, longitudinal containers having a hinged door which opens at one end thereof for delivering and removing articles of mail.

Mailboxes are, of course, common and well-known. One problem that often occurs with mailboxes is easy access to mail during the time when the homeowners are gone. Put another way, mail continues to pile up in the mailbox and is not removed. This is mail highly susceptible to theft because of the easy accessibility by simply opening the box door. It is, of course, necessary that the box door be easily accessible for the mailman on a daily basis. The theft of personal mail is one of the most insidious crimes threatening America today. For example, a new credit card may be stolen by a mail thief and the true owner will have no idea the credit card has been stolen until a large bill arrives, and the battle with the credit card company begins. The theft of social security checks is another common occurrence, the thefts facilitated by the knowledge that social security checks are sent out periodically at a publicly-known interval. Thus, during periods of time when homeowners are gone, there is a substantial risk of security violations for mailboxes.

In the past there have been some attempts at development of more secure mailboxes which perform both the function of easy access for mail carriers, and at the same time provide some means for storage in a non-accessible box area. However, generally those that have been developed in the past are bulky, use complex mechanical elements that are susceptible to failure, and are in effect cost prohibitive for real world use.

Accordingly, there is a real and continuing need for the development of mailboxes having both easy access for mail carriers, and at the same time having secure areas for mail storage, while at the same time doing so with a minimum of mechanical parts and yet provide a cost-effective mailbox. This invention has as its primary objective the fulfillment of this need.

SUMMARY OF THE INVENTION

The above-discussed disadvantages of the prior art are overcome by a unit that is located inside a mailbox and which prevents access to the mailbox through the door of the mailbox when the unit is in place. The unit includes a fence-like portion that is attached to the mailbox body by an arm that is locked to the mailbox in the rear of the mailbox. The fence-like portion is locked to the arm and is attached to the mailbox by a hinge. When unlocked, the fence can be pivoted out of the way to allow access to inside of the mailbox.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
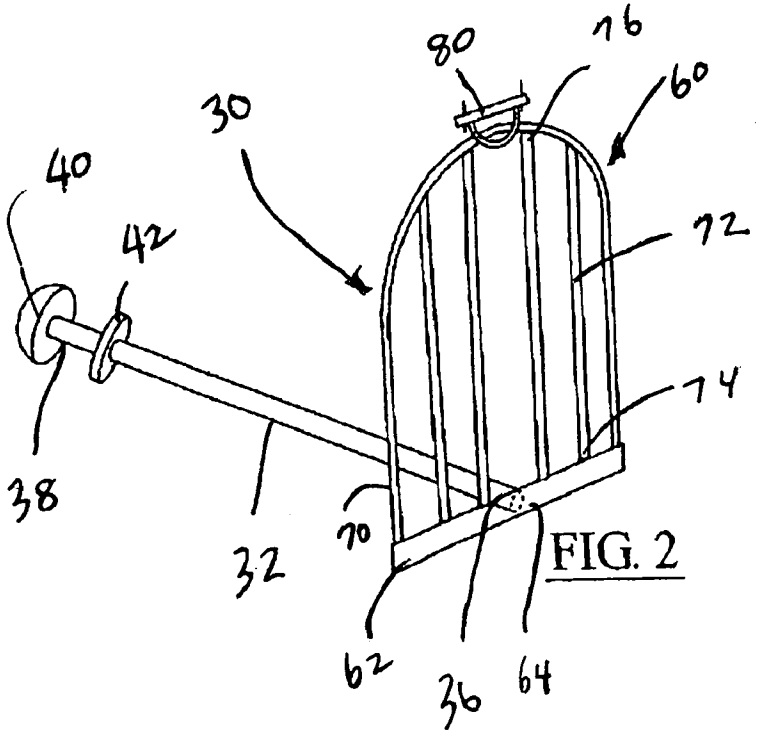
FIG. 2 is a perspective view of a locking unit embodying the present invention

Referring to the figures, it can be understood that the present invention is embodied in a secure mailbox 10. As shown, the locking unit is used to secure a mailbox 12 which has a body 14 with a closed end 16 and an open end 18. A longitudinal axis 20 extends between the closed end and the open end. A door 24 is attached to the body to cover and uncover the open end and an interior volume 26 is defined in the body and which accommodates mail placed therein. The door is shown in the open position in FIG. 1.

A security cage 30 cooperates with the mailbox to ensure the security of the contents of the mailbox. Security cage 30 includes an arm 32 which is located in the interior volume of the body when the arm is in mail securing position and which extends in the direction of the longitudinal axis of the body of the mailbox and is located centrally of the body.

The arm has a first end 36 that is a distal end and which is located adjacent to the open end 18 of the body when the arm is in the mail securing position and a second end 38 which is a proximal end when the arm is in the mail securing position in the interior volume of the body. A knob 40 is fixedly mounted on the second end of the arm and is located outside the body when the arm is in the mail securing position. A washer lock 42 is located on the arm adjacent to the knob and is located inside the interior volume of the body when the arm is in the mail securing position. The washer lock abuts the body of the mailbox and cooperates with the knob to lock the second end of the arm to the body and to securely lock the arm to the body.

Figure 1:
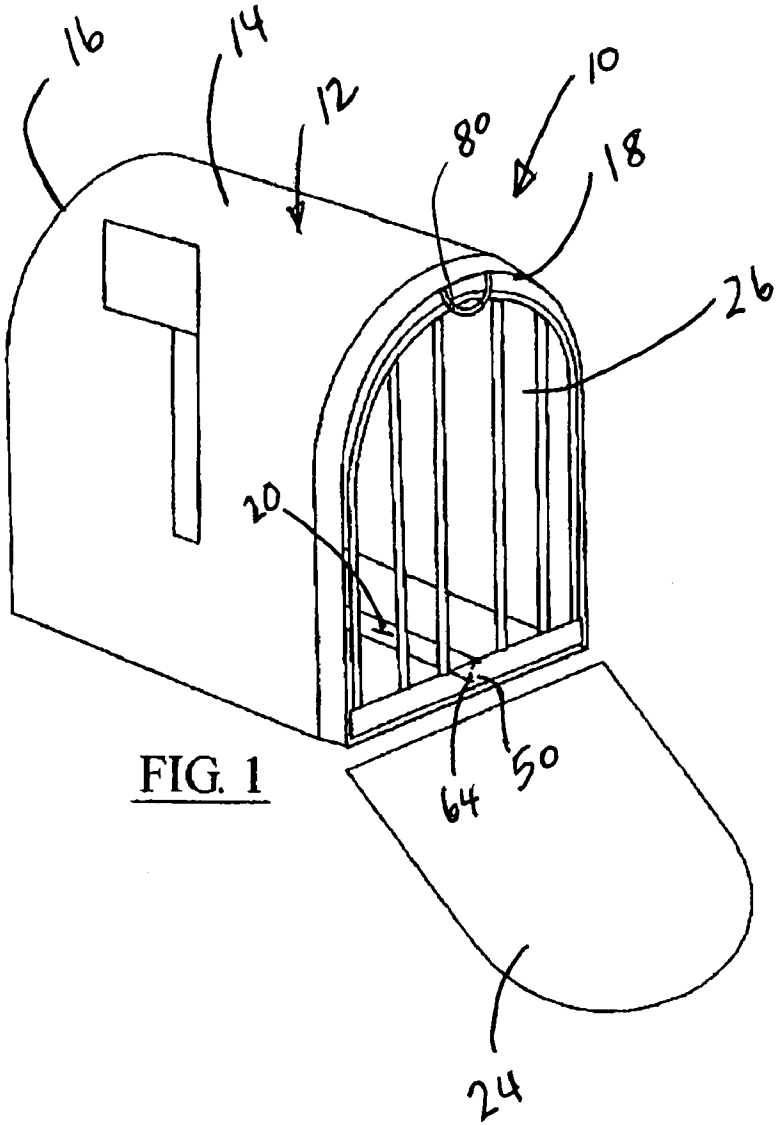
FIG. 1 is a perspective view of a locking unit embodying the present invention located inside a mailbox.

A lock element 50 is located on the distal end of the arm and can be a key lock with mail delivery personnel having the key. A bar section 60 is mounted on the distal end of the arm to be located in the open end of the body of the mailbox when the arm is in the mail securing position as shown in FIG. 1. The bar section is shaped to match the shape of the open end of the body of the mailbox so the open end of the mailbox is completely covered by the bar section when the bar section covers that open end. The bar section includes a base 62. A lock element 64 is located on the base and cooperates with lock element 50 on the arm to lock the base to the arm when the lock elements 50 and 64 are in a locked condition and to free the base from the arm when the lock elements are in an unlocked condition.

A perimeter defining bar 70 is in the shape of the open end of the mailbox and is fixedly mounted on the base. A plurality of bars 72 are each fixedly secured to the base at one end 74 thereof and fixedly secured to the perimeter defining bar at a second end 76 thereof. The bars are located in covering relation with respect to the open end of the body of the mailbox when the bar section is in a mailbox locking orientation as shown in FIG. 1.

A hinge element 80 is mounted on the body of the mailbox adjacent to open end 18 of the body of the mailbox. The hinge element is movable between a first orientation and a second orientation. Perimeter defining bar 70 is connected to the hinge element for movement therewith. The bar section is positioned in the covering relation with respect to the open end of the body of the mailbox when the hinge is in the first position and in an open end uncovering position when the hinge is in the second position so the bar section can be moved out of the way during authorized insertion and removal of items into and out of the interior volume of the mailbox. The bar section is locked to the arm by the locking elements for locking the mailbox to prevent unauthorized insertion and/or removal of items into or out of the mailbox.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A secure mailbox comprising:

A) a mailbox having (1) a body with a closed end and an open end, (2) a door attached to the body to cover and uncover the open end, and (3) an interior volume into which mail is placed; and B) a security cage which includes (1) an arm which is located in the interior volume of the body when the arm is in a mail securing position, the arm having (a) a first end that is a distal end and which is located adjacent to the open end of the body when the arm is in the mail securing position, (b) a second end which is a proximal end when the arm is in the mail securing position in the interior volume of the body, (c) a knob fixedly mounted to the arm on the second end of the arm, the knob being located outside the body when the arm is in the mail securing position, and (d) a washer lock on the arm adjacent to the knob and which is located inside the interior volume of the body when the arm is in the mail securing position, the washer lock abutting the body of the mailbox and cooperating with the knob to lock the second end of the arm to the body and to securely lock the arm to the body, and (e) a lock element on the distal end of the arm, and (2) a bar section mounted on the distal end of the arm to be located in the open end of the body of the mailbox when the arm is in the mail securing position, the bar section including (a) a base, (b) a lock element on the base, the lock element on the base cooperating with the lock element on the arm to lock the base to the arm when the lock elements are in a locked condition and to free the base from the arm when the lock elements are is in an unlocked condition, (c) a perimeter defining bar fixedly mounted on the base, and (d) a plurality of bars each of which has one end fixedly secured to the base and a second end fixedly secured to the perimeter defining bar, the bars covering the open end of the body of the mailbox when the bar section is mounted to the arm and the arm is in the mail securing position, and (3) a hinge element mounted on the body of the mailbox adjacent to the open end of the body of the mailbox, the hinge element being movable between a first orientation and a second orientation, (4) the perimeter defining bar of the bar section being connected to the hinge element for movement therewith, the bar section covering the open end of the body of the mailbox when the hinge is in the first position and in an open end uncovering position when the hinge is in the second position.

2. A secure mailbox comprising:

A) a mailbox having (1) a body with a closed end and an open end, (2) a door attached to the body to cover and uncover the open end, and (3) an interior volume into which mail is placed;

B) a security cage which includes (1) an arm which is located in the interior volume of the body of the mailbox, the arm having one end connected to the body of the mailbox and a second end located adjacent to the open end of the body of the mailbox, (2) a base element, and (3) a plurality of bars fixedly secured to the base element, C) the base element and the arm including cooperating lock elements which lock the base element to the arm;

D) a hinge element mounted on the body of the mailbox adjacent to the open end of the body of the mailbox, the hinge element being movable between a first orientation and a second orientation, E) the security cage being connected to the hinge element to move between a first position covering the open end of the body of the mailbox when the hinge is in the first orientation and a second position uncovering the open end of the body of the mailbox when the hinge element is in the second orientation.

* * * * *